US009566617B2

(12) United States Patent
Jensen

(10) Patent No.: US 9,566,617 B2
(45) Date of Patent: Feb. 14, 2017

(54) POP-UP NOZZLE, CLEANING DEVICE AND METHOD OF OPERATION

(75) Inventor: Thomas Willum Jensen, Vaerlose (DK)

(73) Assignee: GEA Process Engineering A/S, Soborg (DK)

( * ) Notice: Subject to any disclaimer, the term of this patent is extended or adjusted under 35 U.S.C. 154(b) by 541 days.

(21) Appl. No.: 14/122,011

(22) PCT Filed: Jul. 6, 2011

(86) PCT No.: PCT/DK2011/050265

§ 371 (c)(1),
(2), (4) Date: Dec. 26, 2013

(87) PCT Pub. No.: WO2013/004231

PCT Pub. Date: Jan. 10, 2013

(65) Prior Publication Data

US 2014/0124009 A1 May 8, 2014

(51) Int. Cl.

| | |
|---|---|
| ***B08B 9/00*** | (2006.01) |
| ***B08B 3/02*** | (2006.01) |
| ***B05B 15/10*** | (2006.01) |
| ***B08B 9/093*** | (2006.01) |
| ***B05B 13/06*** | (2006.01) |

(52) U.S. Cl.

CPC ..... *B08B 3/02* (2013.01); *B05B 13/0618* (2013.01); *B05B 15/10* (2013.01); *B08B 9/093* (2013.01)

(58) Field of Classification Search

None

See application file for complete search history.

(56) References Cited

U.S. PATENT DOCUMENTS

| | | | |
|---|---|---|---|
| 4,913,346 | A | 4/1990 | Nakamura et al. |
| 5,050,801 | A | 9/1991 | Ferrari |
| 5,096,122 | A | 3/1992 | Abramoska |

(Continued)

FOREIGN PATENT DOCUMENTS

| | | | |
|---|---|---|---|
| CN | 1187150 | A | 7/1998 |
| CN | 101848775 | A | 9/2010 |

(Continued)

OTHER PUBLICATIONS

Communication dated Jun. 24, 2015 from the Chinese Intellectual Property Office issued in corresponding Chinese application No. 201180071941.9.

*Primary Examiner* — Michael Barr
*Assistant Examiner* — Jason Riggleman
(74) *Attorney, Agent, or Firm* — Sughrue Mion, PLLC

(57) ABSTRACT

A nozzle for cleaning-in-place of a vessel has a nozzle body to be connected to a wall of the vessel and defining an opening, a nozzle insert is contained within the nozzle body and is able to assume at least two distinct positions relative to the nozzle body, a first position in which the nozzle insert is retracted into the nozzle body and a second position in which the nozzle insert is advanced in the axial direction relative to the nozzle body and protrudes into the vessel. Apertures are exposed in the second position to allow distribution of a cleaning fluid. The nozzle insert has two nozzle insert parts, in mutual abutment in the first position and spaced from each other in a direction transverse to the axial direction in the second position to form a gap between adjacent nozzle insert parts, the apertures being exposed in the gap.

11 Claims, 3 Drawing Sheets

(56) References Cited

U.S. PATENT DOCUMENTS

| | | | | |
|---|---|---|---|---|
| 5,193,746 | A * | 3/1993 | Iwamura | B05B 15/0241 239/104 |
| 5,642,860 | A | 7/1997 | Bush et al. | |
| 2005/0121544 | A1 | 6/2005 | Pavlik | |
| 2008/0053482 | A1 | 3/2008 | Astheimer et al. | |
| 2009/0159723 | A1 | 6/2009 | Hornsby et al. | |

FOREIGN PATENT DOCUMENTS

| | | | |
|---|---|---|---|
| CN | 101945709 | A | 1/2011 |
| DE | 102 08 237 | C1 | 6/2003 |
| GB | 2 346 945 | A | 8/2000 |
| GB | 2346945 | A * | 8/2000 |

* cited by examiner

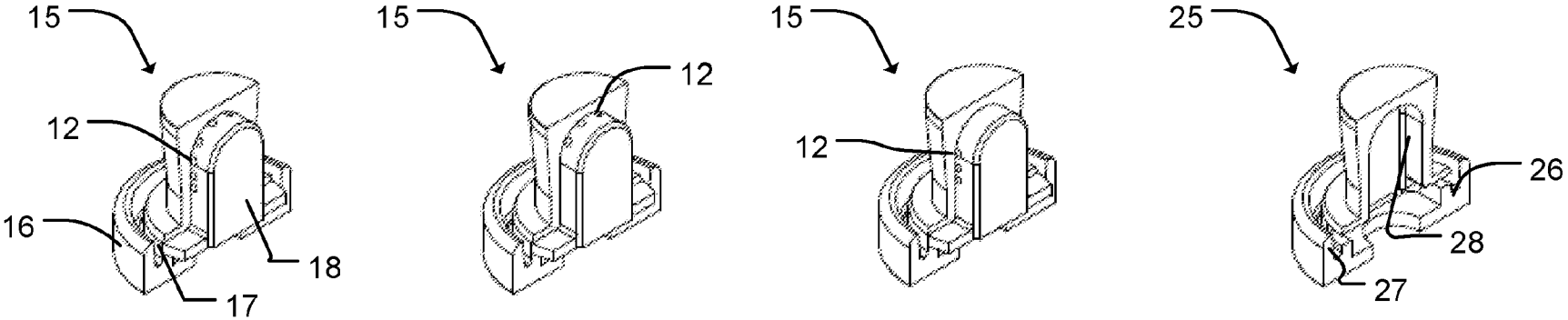
Fig. 11
Fig. 12
Fig. 13
Fig. 14
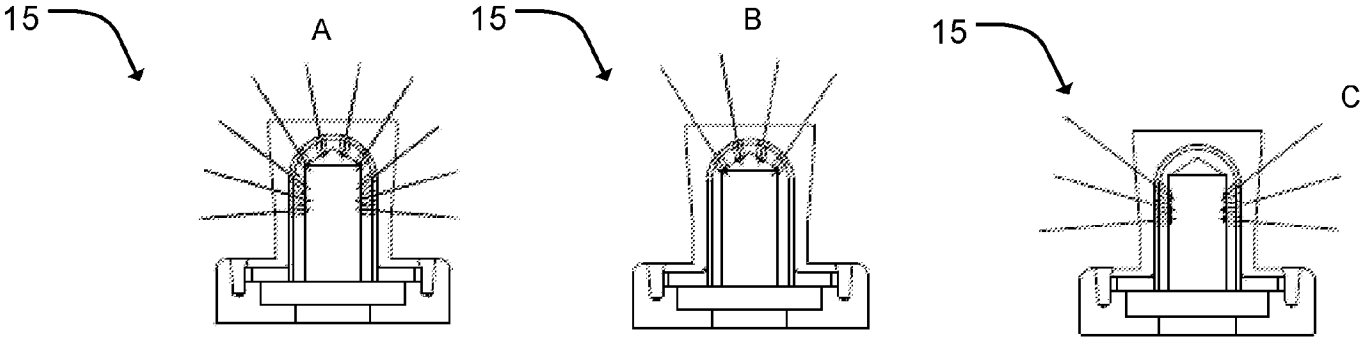
Fig. 15
Fig. 16
Fig. 17

POP-UP NOZZLE, CLEANING DEVICE AND METHOD OF OPERATION

FIELD OF THE INVENTION

The present invention relates to a nozzle for cleaning-in-place of a vessel, comprising a nozzle body adapted to be connected to a wall of the vessel and defining an opening, and a nozzle insert contained within the nozzle body, the nozzle insert having an axial direction and being adapted to assume at least two distinct positions relative to the nozzle body, of which in a first position, the nozzle insert is retracted into the nozzle body and a front end of the nozzle insert is substantially flush with a front end of the nozzle body, and in a second position, the nozzle insert is advanced in said axial direction relative to the nozzle body and is adapted to protrude into the vessel, a plurality of apertures being exposed in said second position to allow distribution of a cleaning fluid. The present invention also relates to a cleaning device including at least one nozzle, and a method of operating the cleaning device.

BACKGROUND OF THE INVENTION

In process equipment, including components containing one or more of gases, liquids and/or powders, such as for instance spray drying chambers, cyclones, bag filters, fluid bed chambers, process chambers, containers, tanks, ducts or any similar vessel, regular cleaning is necessary in order to meet the requirements set by governmental regulations and/or manufacture specifications. Such cleaning is carried out at suitable intervals to avoid product degradation, contamination and build-up of deposits in the components. In order to keep the time needed for cleaning as short as possible without the disassembly of any components, cleaning-in-place (CIP) systems have been developed, which make it possible to clean the interior of such components in an effective manner and thereby minimize cleaning time and maintain high plant productivity. The CIP systems are possibly automated in order to render the cleaning even more efficient, thus making use of computer programmed cleaning sequences. In addition to providing an increased degree of cleaning, efficient cleaning entails that less CIP fluid is used. This in turn provides for a better overall process economy, but is above all more environmentally sound, as the amount of CIP fluid to be filtered and possibly cleaned and/or disposed of is reduced as well.

Use of nozzles for distributing cleaning fluid in such CIP systems is well-established and examples of cleaning nozzles in the prior art are numerous. The nozzle or nozzles should be located in such a manner in the component that the required area of the inner walls of the component is covered by cleaning fluid during the cleaning procedure to an appropriate extent. This may be achieved as in US 2008/0053482 A1, in which a plurality of stationary nozzles is located on a shaft inside the rotatable vessel and the individual nozzles are directed to different sections of the vessel. In the kind of nozzle disclosed in DE 102 08 237 C1 and U.S. Pat. No. 5,096,122, a rotatable nozzle head is connected to a stationary nozzle body. Off-center apertures formed in the nozzle head cause the nozzle head to rotate by the reaction forces exerted by the cleaning fluid. In this manner, a larger area of the interior of the vessel may be covered by a single nozzle. A structurally similar nozzle is disclosed in U.S. Pat. No. 4,913,346, however, the driving force for rotating the nozzle head is provided by the transmission of a magnetic force.

The above-mentioned nozzles are at least partly permanently located inside the vessel to be cleaned. This configuration is not desirable or possible in all applications, as the nozzles themselves firstly may cause disturbance to the process, and secondly they are prone to the formation of deposits and possible contamination; this applies especially to dairy plants, in which the hygiene requirements are particularly strict, not least in the infant food sector of this industry.

In a commercially available nozzle traded by GEA Niro, this disadvantage is alleviated by a nozzle design, in which the nozzle body has a flange welded to the wall of a component such as a vessel of a plant, and the nozzle insert is movable from a first or retracted position, in which a front surface of the nozzle insert is substantially flush with the flange of the nozzle body, to a second or an advanced position, in which the front of the nozzle insert protrudes into the vessel. The nozzle insert is fitted with a spray ring provided with a number of off-center apertures that are exposed in the advanced position. When cleaning fluid is supplied to the nozzle, the spray ring rotates according to the feed pressure. The translational movement of the nozzle between its retracted and advanced positions may be carried out by the pressure of the cleaning fluid itself, or the nozzle may be pneumatically operated.

Although this nozzle design has proven well over a number of years and provides a well-functioning compromise between the need to have a smooth front surface of the nozzle during operation and the desire to spray in several directions during cleaning, it has some disadvantages. For instance, due to the design of the nozzle, the spray angle is limited to a circumferential sector ranging from 0 to approximately 60 or 70 degrees. Thus, spraying in angles close to the axial direction is not possible. This must be considered when designing the configuration and number of the individual nozzles in the vessel and nozzles must be provided to cover the area opposite each individual nozzle, thus increasing the overall number of nozzles necessary to clean the vessel. Furthermore, the cleaning effect is dependent on the self-rotation of the spray ring, and if small impurities or deposits get caught in any of the rotating parts of the nozzle, rotation of the spray ring may be impeded, possibly to such an extent that the spray ring does not rotate at all.

CIP systems are used in both food, dairy, pharmaceutical and chemical industries. The cleaning fluid may be water or possibly an alternating use of water and suitable detergents or cleaning agents. For some purposes, CIP may be used in combination with a further sterilization process.

SUMMARY OF THE INVENTION

With this background, it is an object of the invention to provide a nozzle, by which it is possible to spray in a larger angle interval and reduce the number of nozzles in a cleaning system.

In a first aspect, this and further objects are obtained by a nozzle of the kind mentioned in the introduction, which is furthermore characterized in that said nozzle insert comprises at least two nozzle insert parts, and that said nozzle insert parts are in mutual abutment in the first position and spaced from each other in a direction transverse to said axial direction in the second position to form at least one gap between adjacent nozzle insert parts, said apertures being exposed in said gap.

By this design, it is at the same time possible to maintain the substantially unbroken, smooth surface at the front end of the nozzle, when the nozzle assumes its first position, but at the same time allow for an individually designed configuration of apertures which are exposed in the gap or gaps formed between adjacent nozzle insert parts. In particular, it is possible to provide one or more apertures directed substantially in the axial direction of the nozzle insert, thereby making it possible to spray cleaning fluid on to the vessel wall opposite the nozzle insert in the second position of the nozzle, without having an aperture that is open and thereby exposed to the process in the vessel in the first position. In principle, it is possible to provide a spray angle of substantially 180°.

Although the opening in the nozzle body and hence the front end of the nozzle insert may have a number of various shapes, the front end of the nozzle insert advantageously has a substantially circular cross-section and corresponds in substance to the opening in the nozzle body, the front end of each nozzle insert part having a cross-section corresponding to a circular segment. Circular and other rounded shapes have the advantage that no corners are present which may be the source of gatherings of deposits, malfunctioning of the relative movement between the nozzle insert and the stationary nozzle body.

The number of nozzle insert parts may in principle be varied according to for instance design specifications, however, the nozzle insert of a preferred embodiment comprises two nozzle insert parts, the front end of each nozzle insert part having substantially the cross-section of a semicircle, which combined corresponds substantially to the opening in the nozzle body.

In order to move the nozzle insert from the first position, in which the nozzle insert parts abut each other, to the second position, in which the nozzle insert parts are spaced apart in the transverse direction to form the gap, a combination of movements may be carried out in any suitable manner. For instance, the nozzle insert parts may first be moved in a translational movement along the axial direction to attain the advanced, second position and then be moved outwards, i.e. in the transverse, radial direction. In an embodiment, which provides for a simple and reliable operation entailing simultaneous axial and radial movement of the nozzle insert parts, the diameter of the nozzle insert increases in the axial direction from a back end to the front end, providing the nozzle insert with a substantially conical shape. The radially outer surfaces of the part-conical nozzle insert parts thus follow the edge of the opening in the stationary nozzle body.

The nozzle insert parts may be held in the spaced apart position in the second position of the nozzle in any suitable manner in order to maintain the gap or gaps and thereby expose the apertures during the cleaning process. However, in a mechanically simple embodiment, the nozzle insert is provided with engagement means at the back end adapted to engage with corresponding engagement means of the nozzle body in said second position. Thus, the means for keeping the nozzle insert parts in the correct position during cleaning is maintained within the nozzle itself, without the need for controlling that the position is upheld by external means.

In a particularly simple and reliable embodiment, the engagement means of the nozzle insert is formed as a ring-shaped portion at the back end of each nozzle insert part. The ring-shaped portion includes a track adapted to engage with a circular upstanding rib in the nozzle body, where each track has a shape such that the track fits on the circular upstanding rib in the second position. The nozzle insert parts are thus forced into engagement with the nozzle body and are kept in the spaced apart position as the engaged position is the only one allowed for by the particular design of the rib and the tracks, respectively.

In principle, the aperture or apertures formed within the nozzle insert may be provided in a separate part, which is hidden behind the front ends of the nozzle insert parts in the first position, and which is exposed and possibly advanced in the second position of the nozzle. However, in a preferred embodiment, said plurality of apertures is provided in a section integral with at least one nozzle insert part, and wherein the adjacent nozzle insert part has a recess for accommodating the section in the first position of the nozzle. By this design, manufacture, assembly and operation of the nozzle are made easy and reliable, as the section comprising the apertures is kept inside the other nozzle insert part or parts when the nozzle is in its first or retracted position, thus preventing outflow of cleaning fluid and while at the same time, the section moves with the remaining nozzle insert to attain the second or advanced position.

In a development of this preferred embodiment, the section provided with apertures extends over substantially the entire edge of the nozzle insert part. In addition to assisting in the safe retention and sealing of the section in the other nozzle insert part or parts in the first position, this design provides for optimal cleaning conditions, as the spray angle may be formed to cover substantially 180° in the second, advanced position.

In all embodiments of the invention, it is a prerequisite that the nozzle insert is movable in the axial direction relative to the nozzle body in order to assume the retracted and advanced position. In one preferred embodiment, the nozzle insert is rotatable relative to the nozzle body. By this embodiment, the nozzle is able to flush an area of up to 360° around its axis.

In a second aspect of the present invention, a cleaning device is provided. The cleaning device includes at least one nozzle according to the first aspect of the invention, and is furthermore characterized in that each nozzle is connected to an actuator capable of at least linear movement. By connecting each nozzle to an actuator, a controlled operation of each individual nozzle is obtained, as the movement of the nozzle insert in the axial direction between the first, retracted and second, advanced positions is carried out independently of the pressure of the cleaning fluid.

Preferably, said actuator is capable of linear and rotational movement. This makes it possible to verify or validate that each individual nozzle has in fact been gone through a sequence of steps including advancement, rotation through a predefined number of rotations according to a predefined number of degrees, and retracted to its position of origin.

In a third aspect of the invention, a method of operating such a cleaning device is provided, the method comprising the steps of: providing a cleaning device with at least one nozzle, connecting an actuator to each said at least one nozzle, connecting each nozzle to a supply of cleaning fluid, defining a cleaning programme involving linear movement of said actuator(s) and thereby of the nozzle insert of each at least one nozzle, and registering the movement of the actuator(s).

Preferably, the actuator is capable of linear and rotational movement, and the cleaning programme involves rotational movement of said actuator and thereby of the nozzle insert through a predefined number of rotations.

Further embodiments and advantages will appear from the following description. Details relating to any one aspect of the invention may apply to the other aspects as well.

BRIEF DESCRIPTION OF THE DRAWINGS

FIGS. 11 to 14 show details of embodiments of the nozzle according to the invention; and FIGS. 15 to 17 are schematic presentations of spray patterns of the nozzles in the embodiments of the invention shown in FIGS. 11 to 13, respectively.

Like elements have the same reference numerals.

DETAILED DESCRIPTION OF THE INVENTION AND OF PREFERRED EMBODIMENTS

Figure 1:
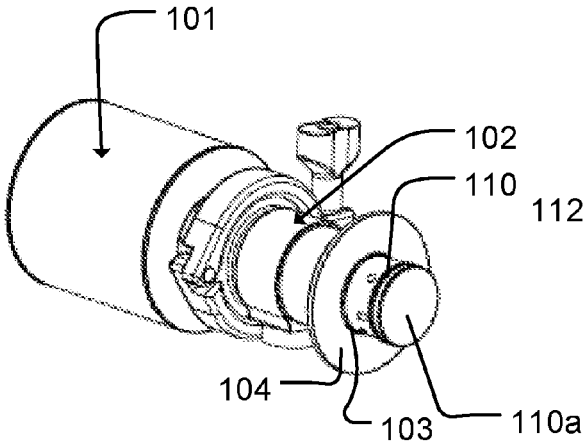
Fig. 1 (Prior art)
FIG. 1 is a perspective view of a nozzle of the prior art.
Figure 2:
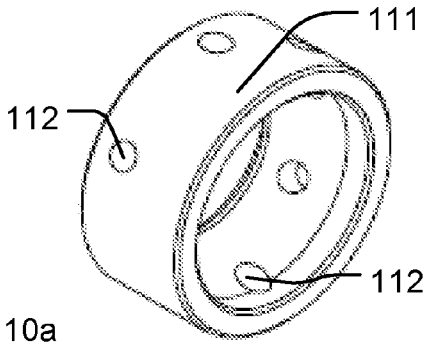
Fig. 2 (Prior art)
FIG. 2 is a perspective view, on a larger scale, of a detail of the prior art nozzle of FIG. 1.

A prior art nozzle and a detail thereof are shown in FIGS. 1 and 2. The nozzle is a commercially available nozzle traded by GEA Niro. The nozzle generally designated 101 is designed for cleaning-in-place of a component, such as a vessel of a plant (neither the vessel nor other parts of the plant being shown in the drawing), and comprises a nozzle body 102. The nozzle body 102 defines an opening 103 in a flange 104 adapted to be connected to a wall of the vessel in question, for instance by welding, and a nozzle insert 110 contained within the nozzle body 102 and having a front end 110*a* generally corresponding to the opening 103 of the nozzle body 102. The nozzle insert 110 has an axial direction coinciding with the general longitudinal direction of the nozzle 101 and is adapted to assume two distinct positions relative to the nozzle body 102.

In FIG. 1, the nozzle is in its open position, in which the insert 110 is shown advanced in the axial direction relative to the nozzle body 102. In this position, the front end of the nozzle insert protrudes, in the mounted position, into the vessel. The nozzle insert has thus been moved from a first position (not shown), in which the nozzle insert 110 is retracted into the nozzle body 102 and the front end 110*a* of the nozzle insert is substantially flush with a front end of the nozzle body 102, here the flange 104, at the opening 103 thereof. In order to allow distribution of a cleaning fluid, the nozzle insert 110 is fitted with a spray ring 111 provided with a number of off-center apertures 112 that are exposed in the advanced position. When cleaning fluid is supplied to the nozzle, the spray ring 111 rotates according to the feed pressure. The translational movement of the insert 110 of the nozzle 101 between its retracted and advanced positions may be carried out by the pressure of the cleaning fluid itself, the nozzle insert 110 being biased towards its retracted position, or the nozzle may be pneumatically operated.

Figure 3:
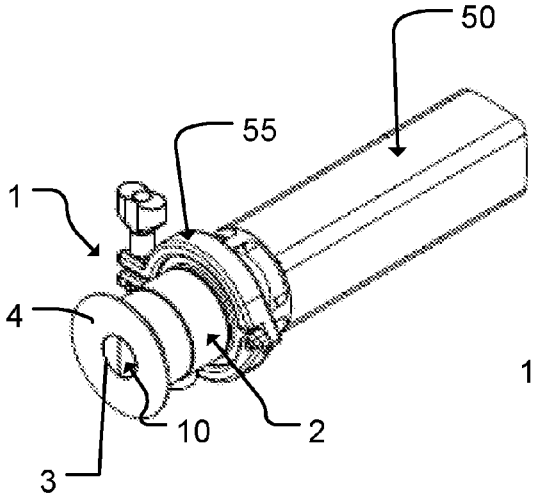
FIG. 3 is a perspective view of a nozzle in an embodiment of the present invention in a first position.
Figure 4:
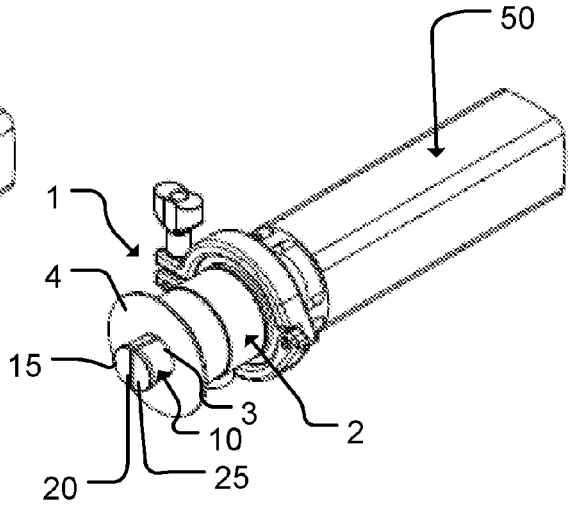
FIG. 4 is a perspective view the nozzle of FIG. 3 in a second position.

Referring now in particular to FIGS. 3 and 4 showing an embodiment of a nozzle 1 according to the invention, the nozzle 1 comprises, as in the prior art nozzle described in the above, a nozzle body 2 having an opening 3 and a flange 4. The nozzle 1 is furthermore provided with a nozzle insert 10, which in the embodiment shown and described comprises two nozzle insert parts 15 and 25, the function and configuration of which will be described in further detail below. In FIG. 3, the nozzle 1 is in its closed position, and in FIG. 4, the nozzle 1 is open to allow for cleaning fluid to be sprayed into the vessel. The nozzle insert parts 15 and 25 are in mutual abutment in the first position shown in FIG. 3 and spaced from each other in a direction transverse to the axial direction in the second position shown in FIG. 4. By spacing apart the nozzle insert parts 15 and 25 in the transverse direction, a gap 20 between adjacent nozzle insert parts 15 and 25 is formed in the second position. The nozzle insert 10 is movable relative to the nozzle body 2. In the embodiment shown and described, the nozzle insert 10 is not only movable in the axial direction but is also rotatable relative to the nozzle body 2 through an angle of up to 360°.

Figure 5:
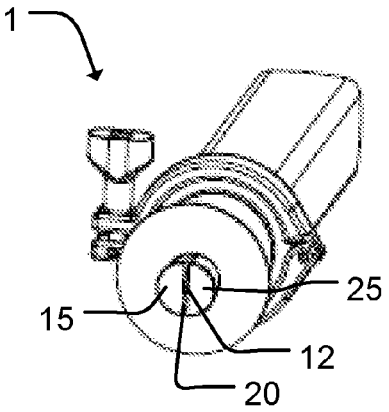
FIG. 5 is a view corresponding to FIG. 4, of the nozzle seen from another angle.
Figure 6:
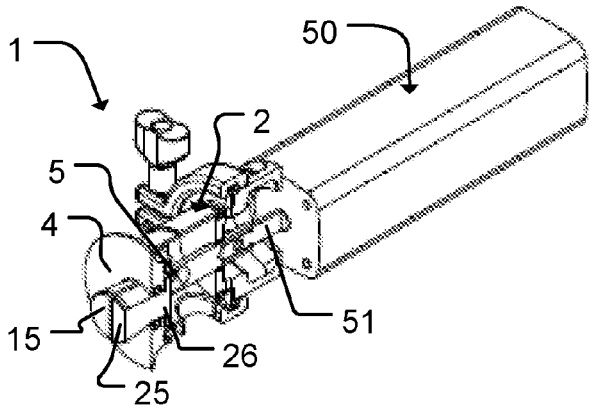
FIG. 6 is a partially sectional view corresponding to FIG. 4.
Figure 7:
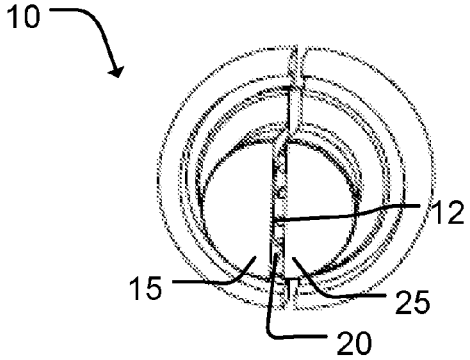
FIG. 7 shows, on a larger scale, a perspective view of a detail of a nozzle in an embodiment of the invention, in the second position shown in FIGS. 4 and 5.
Figure 9:
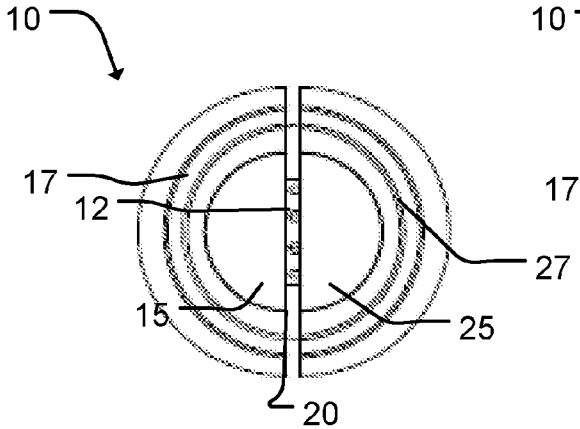
FIGS. 9 and 10 are plan views of a detail of a nozzle in an embodiment of the invention, in two distinct positions.
Figure 10:
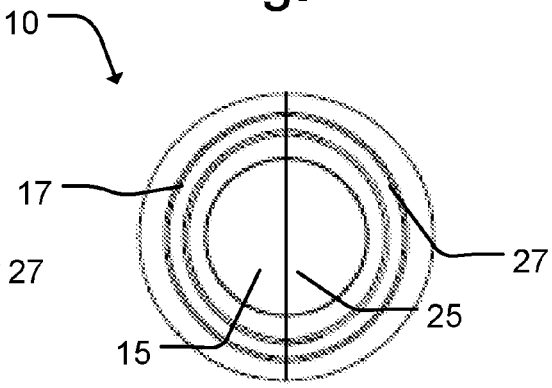

As shown in particular in FIGS. 5, 7 and 9, apertures 12 for spraying cleaning fluid are exposed in the gap 20 between the nozzle insert parts 15 and 25 in the second, advanced position of the nozzle 1.

In the first, retracted position of the nozzle 1, the surface at the front end of the nozzle 1 is substantially unbroken and smooth, as the nozzle insert parts 15 and 25 abut each other tightly, leaving only a minor split between them, just as the transition to the flange 4 of the nozzle body 2 is made substantially flush.

In all of the embodiments shown in the drawings, the front end of the nozzle insert 10 has a substantially circular cross-section and corresponds in substance to the opening 3 in the nozzle body 2. As a consequence, the front end of each nozzle insert part 15, 25 has a cross-section corresponding to a circular segment, namely in the form of a circular sector of substantially 180°, i.e. a semicircle. With the embodied configuration, the direction transverse to the axial direction thus corresponds to a radial direction. Other shapes are conceivable as well, just as the number of nozzle insert parts may in principle be more than the two parts shown.

The material of the nozzle insert parts 15 and 25 may be chosen arbitrarily according to the manufacture and operational conditions, but is advantageously of a moulded plastic material.

Figure 8:
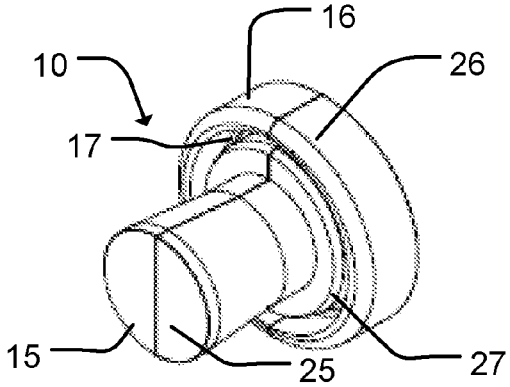
FIG. 8 is a view corresponding to FIG. 7, of the detail of the nozzle in the first position shown in FIG. 3.

As shown most clearly in FIGS. 7 and 8, the nozzle insert has a diameter which increases in the axial direction from a back end to the front end, providing the nozzle insert with a substantially conical shape. During movement of the nozzle insert 10 in the axial direction from the first position, in which the nozzle insert parts 15, 25 abut each other, to the second position, in which the nozzle insert parts 15, 25 are spaced apart in the transverse direction to form the gap 20, the radially outer surfaces of the part-conical nozzle insert parts 15, 25 thus follow the edge of the opening 3 in the stationary nozzle body 2.

Referring now in particular to FIGS. 4, 6, 8 and 10 showing the nozzle 1 in its open position, means are provided for holding the nozzle insert parts 15, 25 in the spaced apart position in the second position of the nozzle 1. Thus, each nozzle insert part 15, 25 is provided with engagement means in the form of a ring-shaped portion 16, 26 at the back end adapted to engage with corresponding engagement means of the nozzle body 2 in the second position. In each ring-shaped portion 16, 26, a track 17, 27 is formed. The tracks 17, 27 have such a shape that they fit onto a circular upstanding rib 5 in the nozzle body 2 in the second position. This is made possible by the fact that the ring-shaped portions 16, 26 and the tracks 17, 27 are formed as circle segments of an angle slightly lower than 180°. Thus, in the first position, shown for instance in FIG. 10, the tracks 17, 27 are coherent but do not form a substantially perfect circle, whereas in the second position, shown in FIG. 9, the tracks 17, 27 and the intermediate portions placed in the gap 20 together form a circle matching the circular upstanding rib 5. The engagement means keep the nozzle insert parts 15, 25 in the correct position during cleaning.

In principle, the aperture or apertures 12 formed within the nozzle insert 10 may be provided in a separate part, which is hidden behind the front ends of the nozzle insert parts 15, 25 in the first position, and which is exposed and possibly advanced in the second position of the nozzle. However, referring to FIGS. 11 to 17 showing a number of preferred embodiments of the nozzle insert parts 15, 25, the plurality of apertures 12 are provided in a section 18 integral with the one nozzle insert part 15. Correspondingly, the adjacent nozzle insert part 25 has a recess 18 for accommodating the section 18 in the first position of the nozzle 1. The section 18 comprising the apertures 12 is kept inside the other nozzle insert part 25 when the nozzle is in its first or retracted position, thus preventing outflow of cleaning fluid and while at the same time, the section moves with the remaining nozzle insert to attain the second or advanced position. In the embodiment shown, the section 18 provided with apertures 12 extends over substantially the entire edge of the nozzle insert part 15.

The number of apertures 12 may vary, and thus the spray angle of each individual nozzle may be designed according to the specific configuration of the cleaning system of the plant. FIGS. 11 to 13 show various configurations of the one nozzle insert part 15 acting as a male part cooperating with a female part in the form of the other nozzle insert part 25 shown in FIG. 14 in that the section 18 is lodged within the recess 28 of the female part 25 in the first, retracted position of the nozzle insert 10.

In the embodiment of FIG. 11, ten apertures 12 are formed in the section 18 providing the spray pattern A shown in FIG. 15, i.e. over a spray angle of about 100° on either side of the axial direction. Correspondingly, the embodiment of the nozzle insert part 15 shown in FIG. 12 has four apertures 12 distributed around the axial direction and providing the spray pattern B shown in FIG. 16. In the embodiment of FIG. 13, six apertures 12 are formed in the sides of the section 18, thus rendering a spray pattern C as shown in FIG. 17. In principle, it is possible to provide a spray angle of substantially 180° covering the entire area ranging from one side of the nozzle through the axial direction to the other side.

The nozzle according to the invention may form part of a cleaning device. Referring to FIGS. 3 to 6, the nozzle 1 is connected to an actuator 50 capable of at least linear movement. By connecting each nozzle to an actuator, a controlled operation of each individual nozzle is obtained, as the movement of the nozzle insert in the axial direction between the first, retracted and second, advanced positions is carried out independently of the pressure of the cleaning fluid. The actuator 50 may be of any commercially available type and is advantageously capable of linear as well as rotational movement. The actuator 50 is connected to the nozzle 1 in that an actuating rod 51 cooperates with the nozzle insert 10. A clamping device 55 clamps the parts of the nozzle 1 and the actuator 50 together. A cleaning device has thus been provided, including a sanitary retractable nozzle, which by connection to an actuator is able to flush an area up to 180° and 360° around its axis. In the case apertures are provided that are directed towards the wall in which the nozzle is mounted, the angle may be even larger than 180°, possibly up to 240°.

The provision of such an actuator 50 makes it possible to verify or validate that each individual nozzle 1 has in fact gone through a sequence of steps including advancement, rotation through a predefined number of rotations according to a predefined number of degrees, and retracted to its position of origin. Thus, one example of a manner of operating such a cleaning device comprises the steps of providing a cleaning device with at least one nozzle, connecting an actuator to each said at least one nozzle, connecting each nozzle to a supply of cleaning fluid, defining a cleaning programme involving linear movement of said actuator and thereby of the nozzle insert, and registrating the movement of actuator. The cleaning programme advantageously involves rotational movement of the actuator and thereby of the nozzle insert through a predefined number of rotations, thus securing that the prescribed area of the vessel has been cleaned. The cleaning programme and the registration documentation may be computerized.

The invention should not be regarded as being limited to the embodiments shown and described in the above, but several modifications may be carried out within the scope of the appended claims.

The invention claimed is:

1. A nozzle for cleaning-in-place of a vessel, comprising a nozzle body adapted to be connected to a wall of the vessel and defining an opening, and a nozzle insert contained within the nozzle body, the nozzle insert having an axial direction and being adapted to assume at least two distinct positions relative to the nozzle body, of which in a first position, the nozzle insert is retracted into the nozzle body and a front end of the nozzle insert is substantially flush with a front end of the nozzle body, and in a second position, the nozzle insert is advanced in said axial direction relative to the nozzle body and is adapted to protrude into the vessel, a plurality of apertures being exposed in said second position to allow distribution of a cleaning fluid, characterized in that said nozzle insert comprises at least two nozzle insert parts, and that said nozzle insert parts are in mutual abutment in the first position and spaced from each other in a direction transverse to said axial direction in the second position to form at least one gap between adjacent nozzle insert parts, said apertures being exposed in said gap.

2. A nozzle according to claim 1, wherein the front end of the nozzle insert has a substantially circular cross-section and corresponds in substance to the opening in the nozzle body, the front end of each nozzle insert part having a cross-section corresponding to a circular segment.

3. A nozzle according to claim 2, wherein the nozzle insert comprises two nozzle insert parts, the front end of each nozzle insert part having substantially the cross-section of a semicircle, which combined corresponds substantially to the opening in the nozzle body.

4. A nozzle according to claim 2, wherein the diameter of the nozzle insert increases in the axial direction from a back end to the front end, providing the nozzle insert with a substantially conical shape.

5. A nozzle according to claim 1, wherein the nozzle insert is provided with engagement means at the back end adapted to engage with corresponding engagement means of the nozzle body in said second position.

6. A nozzle according to claim 5, wherein the engagement means of the nozzle insert is formed as ring-shaped portion at the back end of each nozzle insert part, said ring-shaped portion including a track adapted to engage with a circular upstanding rib in the nozzle body, each track having a shape such that the track fits on the circular upstanding rib in the second position.

7. A nozzle according to claim 1, wherein said plurality of apertures is provided in a section integral with at least one nozzle insert part, and wherein the adjacent nozzle insert part has a recess for accommodating the section in the first position of the nozzle.

8. A nozzle according to claim 7, wherein the section provided with apertures extends over substantially the entire edge of the nozzle insert part.

9. A nozzle according to claim 1, wherein the nozzle insert is rotatable relative to the nozzle body.

10. A cleaning device including at least one nozzle according to claim 1, characterized in that each nozzle is connected to an actuator capable of at least linear movement.

11. A cleaning device according to claim 10, wherein said actuator is capable of linear and rotational movement.

* * * * *